United States Patent [19]

Ouellet

[11] 4,358,943

[45] Nov. 16, 1982

[54] VEHICLE DOOR LOCK

[76] Inventor: Benoit Ouellet, 1053 Imperial St., Greenfield Park, Quebec, Canada, J4V 1L5

[21] Appl. No.: 182,459

[22] Filed: Aug. 28, 1980

[51] Int. Cl.[3] ..... E05B 27/06

[52] U.S. Cl. ..... 70/358; 70/379 R

[58] Field of Search ..... 70/35 B, 364 A, 379 R, 70/379 A, 380, DIG. 5, DIG. 37

[56] References Cited

U.S. PATENT DOCUMENTS

| | | | |
|---|---|---|---|
| 1,334,292 | 3/1920 | Cox | 70/364 A |
| 3,040,557 | 6/1962 | Jacobi | 70/379 R |

*Primary Examiner*—Robert L. Wolfe

[57] ABSTRACT

A vehicle door lock adapted for use with a door latch also operated by an internal lock-unlock pushbutton and/or handle and characterized by a second tumbler assembly angularly spaced around the barrel relative to the usual first tumbler assembly and arranged to lock the barrel and the associated latching lug in the angular position of the second tumbler assembly and such that the latching lug will then lock the corresponding internal manual actuator. This tube prevents one, like a burglar, to open the vehicle doors by maneuvering with a wire around the glass plate of a vehicle door and by pulling up the internal pushbutton.

3 Claims, 7 Drawing Figures

VEHICLE DOOR LOCK

This invention relates to a lock for the door of a vehicle, and more particularly, to a lock of the type used with a door latch also operated from the inside by an internal manual actuator including a lock-unlock pushbutton and/or handle.

The locks of the above type that have been used so far are connected to the latch in such a manner as to allow operation of the latch and unlocking of the door by a conventional lock-unlock pushbutton or by the handle. Such door lock system is convenient, however, it makes it relatively easy for someone like a burglar to unlock the doors of vehicles or cars without using the key. They can quite easily maneuver around the glass plates of most car doors to reach and pull out the lock-unlock pushbutton or handle.

It is a general object of the present invention to avoid the above mentioned disadvantages of the rather easily accessible inside lock-unlock pushbutton and handle.

It is a more specific object of the present invention to provide a vehicle door lock of the above type that is adapted to lock the associated internal manual actuators for the corresponding vehicle door lock against unauthorized actuation and resultant unlocking of the corresponding door lock.

It is a further object of the present invention to provide a vehicle door lock of the above type that is also of simple construction and operation and very slightly alters the vehicle door locks that were used so far.

The above and other objects and advantages of the present invention will be better understood with reference to the following detailed description of a preferred embodiment thereof which is illustrated, by way of example, in the accompanying drawings, in which.

Figure 1:
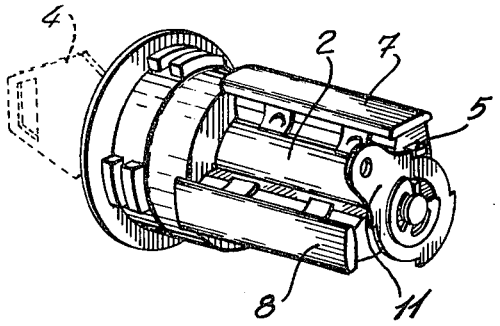
FIG. 1 is a perspective view of a vehicle door lock according to the present invention.
Figure 2:
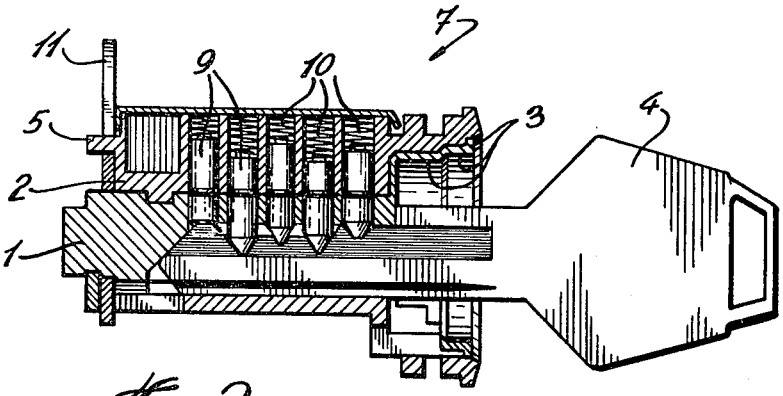
FIG. 2 is a cross-sectional view of the same vehicle door lock as seen along a plane through the key receiving slot.
Figure 3:
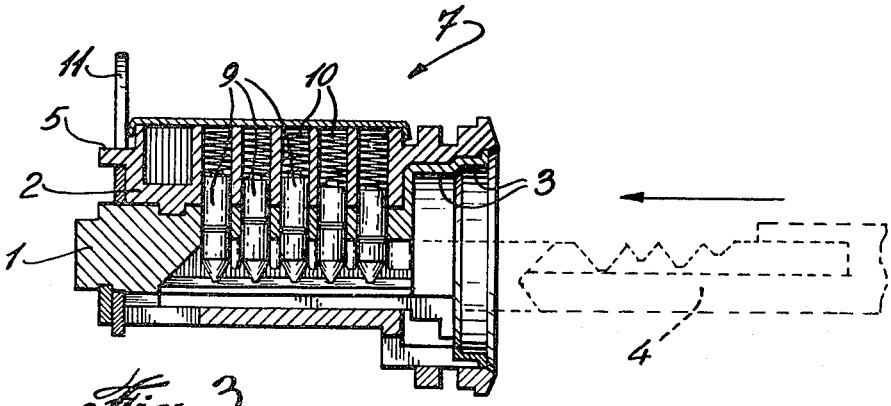
FIG. 3 is the same as FIG. 2 but with the key removed.
Figure 4:
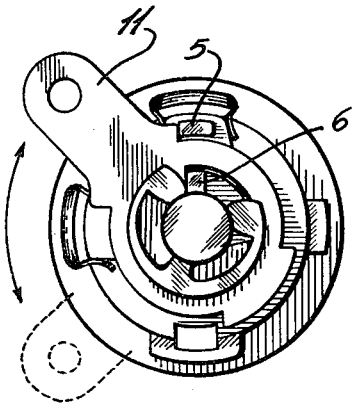
Figure 5:
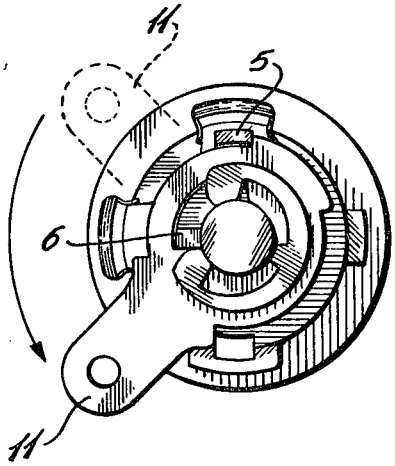
Figure 6:
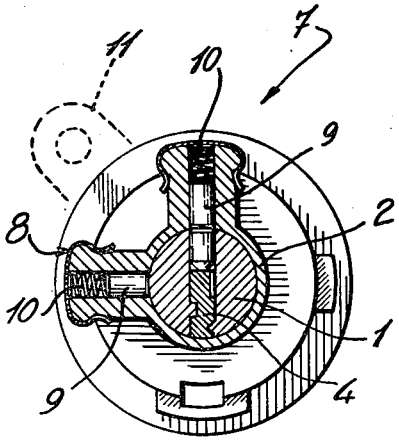
Figure 7:
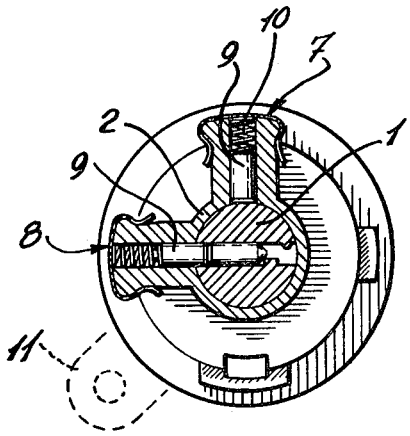

FIGS. 4 and 5 are end views of the door lock with the latching member in two different positions respectively; and FIGS. 6 and 7 are cross-sectional views transversely through the door locks in the positions of FIGS. 4 and 5 respectively.

The illustrated vehicle door lock is of the general type now used by at least one large automobile manufacturer. This door lock includes an inner barrel 1 and a fixed casing 2 engaged around the barrel 1 and rotatably holding the latter. The barrel 1 is of conventional construction with a key receiving slot extending in a plane through the rotation axis of the barrel.

The casing 2 is generally tubular defining a chamber of rotation for the barrel. The outer end of the casing is provided with a cup shaped trim 3 of conventional construction guiding the insertion of the key 4 into the key receiving slot of the barrel 1. The outer end of the casing 2 is provided with an axially projecting and fixed lug 5. The barrel 1 is provided with an axially projecting latching lug 6 that rotates therewith.

A first and a second tumbler assemblies 7 and 8 are secured or mounted on the fixed casing 2 at predetermined angular positions around the axis of the barrel 1. Each tumbler assembly is of conventional construction with tumbler pins 9 and springs 10 to conventionally restrict the unlocking to a key 4 having the right key combination as defined by the indentation of the key. It must be noted that both tumbler assemblies 7 and 8 have the same key combination or signature as defined by the lengths of the tumbler pins 9. In the illustrated embodiment, the tumbler assemblies are positioned at 90° one to the other. This is related to the angular rotation of the barrel that is required to go from the latching to the unlatching position.

A latching arm 11 is pivoted on the inner end of the casing 2 to be connected at its free end to actuate the door latch (not shown) and to be actuated by an internal manual actuator such as for instance the conventional lock-unlock pushbutton (also not shown) and/or door handle.

The FIGS. 4 and 6 illustrate the normal or usual position of insertion of the key at which time the latching arm 11 is up and so is the lock-unlock pushbutton. Then, the latching arm abuts against the fixed lug 5 while the rotatable lug 6 engages against an internal shoulder of the latching arm.

When the key and barrel are bodily rotated to the position of FIGS. 5 and 7, the lug 6 that rotates with the barrel pivots the latching arm 11 to a lowered position. Then, the key can be pulled out due to the second tumbler assembly 8 and the lug 6 locks the latching arm in the lowered position. The lock-unlock pushbutton, not shown, that is attached to the arm is thus also locked against unauthorized lifting thereof.

The concept of the present invention is applicable to other types of latching connections between the lock, the latch, and the pushbutton, as long as it produces locking of the pushbutton at the same time that it locks the latch, by use of a second tumbler assembly angularly positioned in the plane of the locking position of the key.

What I claim is:

1. In a vehicle door lock adapted for use with a door latch also operated by an internal manual actuator including a lock-unlock pushbutton and/or handle, the combination comprising an inner barrel having a key-receiving slot, a fixed casing engaged around the inner barrel and rotatively carrying the latter, a first and a second tumbler assemblies carried by the fixed casing at predetermined angular positions around the rotation axis of the barrel and having each a tumbler lockingly engageable into the key-receiving slot to rotatively lock the barrel in either of a first and a second angular position corresponding to the predetermined angular positions defined by said first and second tumbler assemblies respectively, and a latching lug secured to the barrel and rotatable therewith between said first and second locking positions of the barrel and constructed and arranged to lock the internal manual actuator and the latch upon rotation with the barrel to the second locking position.

2. A vehicle door lock as defined in claim 1, wherein said tumbler assemblies are constructed and arranged with the same key combination and thereby allow insertion and removal of the same key in either of said first and second angular positions of the barrel.

3. A vehicle door lock as defined in claim 2, wherein the door latch is actuated through a latching arm pivotable at the end of the barrel and around the axis thereof and said latching lug operatively abuts against said latching arm upon rotation of the barrel to said second position thereby operatively locking the latching arm against rotation and locking the internal manual actuator against operation on the latching arm.

* * * * *